US012779532B2

(12) United States Patent
Ohno et al.

(10) Patent No.: US 12,779,532 B2
(45) Date of Patent: Nov. 3, 2026

(54) TUNGSTEN-CONTAINING POWDER

(71) Applicant: A.L.M.T. Corp., Tokyo (JP)

(72) Inventors: Masanori Ohno, Toyama (JP); Takuya Kono, Toyama (JP); Fumitaka Gamo, Toyama (JP); Takayuki Fudo, Toyama (JP)

(73) Assignee: A.L.M.T. Corp., Tokyo (JP)

( * ) Notice: Subject to any disclaimer, the term of this patent is extended or adjusted under 35 U.S.C. 154(b) by 470 days.

(21) Appl. No.: 18/266,634

(22) PCT Filed: Dec. 8, 2021

(86) PCT No.: PCT/JP2021/045062
§ 371 (c)(1),
(2) Date: Jun. 12, 2023

(87) PCT Pub. No.: WO2022/138156
PCT Pub. Date: Jun. 30, 2022

(65) Prior Publication Data

US 2024/0100593 A1 Mar. 28, 2024

(30) Foreign Application Priority Data

Dec. 21, 2020 (JP) ..... 2020-211334

(51) Int. Cl.
*B22F 1/05* (2022.01)

(52) U.S. Cl.
CPC ..... *B22F 1/05* (2022.01); *B22F 2301/20* (2013.01); *B22F 2304/10* (2013.01)

(58) Field of Classification Search
CPC .... B22F 1/05; B22F 2301/20; B22F 2304/10; B22F 2999/00; B22F 9/22; B22F 2301/00; C22C 1/0458; C22C 1/1089; C22C 27/04
See application file for complete search history.

(56) References Cited

U.S. PATENT DOCUMENTS

| | | | |
|---|---|---|---|
| 2003/0164063 | A1 | 9/2003 | Elliot |
| 2007/0292758 | A1 | 12/2007 | Uchida et al. |
| 2015/0321254 | A1 | 11/2015 | Naito et al. |
| 2016/0228948 | A1 | 8/2016 | Nakamura |
| 2020/0346935 | A1 | 11/2020 | Hayashi et al. |

FOREIGN PATENT DOCUMENTS

| | | | | | |
|---|---|---|---|---|---|
| CN | 101048346 | A | | 10/2007 | |
| CN | 203695955 | U | | 7/2014 | |
| CN | 105855534 | A | | 8/2016 | |
| CN | 108941530 | A | | 12/2018 | |
| CN | 109047749 | A | | 12/2018 | |
| CN | 109553925 | A | * | 4/2019 | ..... C08K 3/08 |
| CN | 112077330 | A | | 12/2020 | |
| JP | S54-79152 | A | | 6/1979 | |
| JP | H07-221453 | A | | 8/1995 | |
| JP | 2000-154256 | A | | 6/2000 | |
| JP | 2000-154323 | A | | 6/2000 | |
| WO | 2018/070466 | A1 | | 4/2018 | |

OTHER PUBLICATIONS

Li et al.; "Injection molding of tungsten powder treated by jet mill with high powder loading: A solution for fabrication of dense tungsten component at relative low temperature"; Int. Journal of Refractory Metals and Hard Materials 62; Oct. 17, 2016; pp. 42-46 (Year: 2016).*

CN-109553925-A: Espacenet English machine translation (Year: 2019).*

Li, Rui et al., "Injection molding of tungsten powder treated by jet mill with high powder loading: A solution for fabrication of dense tungsten component at relative low temperature", Int. Journal of Refractory Metals and Hard Materials, Oct. 17, 2016, vol. 62, pp. 42-46.

Anonymous, "Relationship between Fisher sub sieve particle size and laser particle size distribution 201-48", HMKTest, Sep. 4, 2024, pp. 1-3, Retrieved from the Internet: URL: https://www.hmktest.com/relationship-betweenfisher-sub-sieve-particle-sizeand-laser-particle-sizedistribution-201-48.

Extended European Search Report dated Sep. 20, 2024 in corresponding European Patent Application No. 21910305.8.

Chinese Office Action dated Feb. 13, 2026 in corresponding Chinese Application No. 202180084274.1, with Machine Translation.

* cited by examiner

*Primary Examiner* — Adil A. Siddiqui
(74) *Attorney, Agent, or Firm* — Renner, Otto, Boisselle & Sklar, LLP

(57) ABSTRACT

In a case where an FSSS average particle size of a tungsten-containing powder as obtained by an FSSS method is defined as a (μm) and a density TD, which is an inverse number of a tap volume of the tungsten-containing powder, is defined as p (g/cm$^3$), a relational expression of $p \geq 0.37a + 7.04$ is satisfied when a range of the FSSS average particle size a is $0.5\ \mu m \leq a \leq 5.0\ \mu m$.

10 Claims, No Drawings

TUNGSTEN-CONTAINING POWDER

TECHNICAL FIELD

The present disclosure relates to a tungsten-containing powder. The present application claims a priority based on Japanese Patent Application No. 2020-211334 filed on Dec. 21, 2020. The entire contents of Japanese Patent Application No. 2020-211334 are incorporated herein by reference.

BACKGROUND ART

Conventionally, a tungsten-containing powder is disclosed, for example, in Japanese Patent Laying-Open No 54-79152 (PTL 1).

CITATION LIST

Patent Literature

PTL 1: Japanese Patent Laying-Open No. 54-79152

SUMMARY OF INVENTION

In a tungsten-containing powder of the present disclosure, in a case where an FSSS average particle size of the tungsten-containing powder as obtained by an FSSS method is defined as a (μm) and a density TD, which is an inverse number of a tapped volume of the tungsten-containing powder, is defined as p (g/cm$^3$), a relational expression of $p \geq 0.37a+7.04$ is satisfied when a range of the FSSS average particle size a is $0.5\ \mu m \leq a \leq 5.0\ \mu m$.

DESCRIPTION OF EMBODIMENTS

Problem to be Solved by the Present Disclosure

When the conventional tungsten-containing powder is used to produce a sintered material, a density variation of the sintered material becomes large, disadvantageously.

DESCRIPTION OF EMBODIMENTS OF THE PRESENT DISCLOSURE

First, embodiments of the present disclosure will be listed and described.

In a conventional method, tungsten oxides such as $WO_3$, $WO_{2.9}$ and $WO_2$ are used as source materials, these source materials are introduced into a metal boat, and the metal boat is moved in a furnace heated to a predetermined temperature, with the result that a reduction reaction by hydrogen gas occurs to produce a tungsten-containing powder.

PTL 1 discloses a method of producing a tungsten-containing powder excellent in sinterability, the method including the steps of: adding 0.03 to 1.0 weight % of molybdenum to any one of ammonium tungstate, ammonium paratungstate, and a tungsten oxide before the reduction step; and reducing at 950° C. or more.

A tungsten metal product, which has a high melting point and is difficult to be produced by a melting method, is normally produced by a powder metallurgical method; however, it is difficult to stably produce products having the same shape because sintering of a metal tungsten in the powder metallurgical method is affected by a property of a powder used.

In order to improve sinterability, a method of adding an additive may be used. Although the addition of an additive leads to improved sinterability, a physical property of the metal is considered to be deteriorated.

Conventionally, the bulk density of a powder can be made high by using a pulverizing device such as a ball mill or a bead mill; however, it is difficult to avoid contamination caused during the pulverization, with the result that a powder property may be affected. By decreasing a density variation in sintering, the shape of a tungsten sintered material can be stabilized.

In one method according to the present disclosure, fine particles, coarse particles, and aggregated particles are removed by classification at each stage of reduction. Thus, a tungsten-containing powder having a high bulk density is obtained. Since no pulverizer is used, occurrence of contamination can be suppressed.

A ratio of tungsten in the tungsten-containing powder should be 90 mass % or more. When the ratio of tungsten is 90 mass % or more, the tungsten-containing powder can contain oxygen and nitrogen, which are gas components, as well as an inevitable impurity element other than the gas components. Further, as a component other than the impurity component, the tungsten-containing powder can include at least one intentionally added additive element among aluminum, calcium, chromium, copper, iron, magnesium, manganese, molybdenum, nickel, silicon, tin, sodium, potassium, and an element belonging to a Group 3. Sodium and potassium can be detected by atomic absorption spectrometry, and the elements other than sodium and potassium can be detected by ICP (Inductively Coupled Plasma). Examples of the element belonging to the Group 3 include scandium, yttrium, lanthanoid and actinoid.

In the tungsten-containing powder of the present disclosure, since fine particles, coarse particles, and aggregated particles are removed, the bulk density of the tungsten-containing powder becomes high, thereby obtaining a sintered material with less density variation when sintering is performed.

The present inventors have found to attain the effect by setting the following property values to fall in predetermined ranges.

Particle Size of Tungsten-Containing Powder (FSSS Method) and TD (Inverse Number of Tap Volume)

In a case where an FSSS average particle size of the tungsten-containing powder as obtained by an FSSS method is defined as a (μm) and a density TD, which is an inverse number of a tap volume of the tungsten-containing powder, is defined as p (g/cm$^3$), $p \geq 0.37a+7.04$ is satisfied when a range of a is $0.5\ \mu m \leq a \leq 5.0\ \mu m$. $p \geq 0.09a+8.44$ is satisfied when $5.0\ \mu m \leq a \leq 30\ \mu m$. More preferable ranges are as follows: $p \geq 0.32a+7.76$ is satisfied when $0.5\ \mu m \leq a \leq 5.0\ \mu m$; and $p \geq 0.1a+8.86$ is satisfied when $5.0\ \mu m \leq a \leq 30\ \mu m$. It should be noted that the upper limit of p is 12.1 g/cm$^3$.

<Tap Density Measurement Method>

An apparent bulk density TD (g/cm$^3$) in a tapping method was measured using a tap volume measurement device (provided by Seishin Enterprise) in accordance with JIS Z 2512 (2012).

<Density Variation of Sintered Material>

When the density variation of the sintered material is defined as e, e is 0.05 g/cm$^3$ or more and 0.20 g/cm$^3$ or less. The density variation of the sintered material is defined as a difference between the maximum value and the minimum value when measuring the densities of ten sintered materials.

A more preferable range of e is 0.05 g/cm$^3$ or more and 0.15 g/cm$^3$ or less.

In order to measure the density variation of the sintered material, a compact is prepared by using only tungsten-containing powder having uniform particles with an FSSS average particle size a of 0.5 μm to 30 μm by the FSSS method. A method of measuring the compact is as follows: a powder containing 30 g of tungsten was introduced into a mold having a length of 10 mm and a width of 30 mm, and press molding was performed to apply a pressure of 98 MPa using a 30 t press machine. The press-molded compact was sintered at 1300 to 1900° C. for 3 h, and the density of the sintered material was measured using an Archimedes method.

<Production Method>

In order to produce the tungsten-containing powder, a tungsten oxide powder is reduced in accordance with below-described steps 1 to 7. The following describes each of step 1 (source material preparation), step 2 (source material sieving), step 3 (reduction step), step 4 (intermediate sieving 1), step 5 (reduction step), step 6 (intermediate sieving 2) and step 7 (reduction step) in detail.

Step 1: Source Material Preparation

Examples of oxide source materials mainly include $WO_3$, $WO_{2.9}$, and $WO_2$. From these, an optimum source material is selected for each particle size.

Step 2: Source Material Sieving

A sieve mesh having a predetermined mesh size is installed for each source material, and the source material is caused to pass therethrough and is collected with coarse particles and fine particles being removed. The mesh size of the sieve mesh is appropriately changed in accordance with a source material and a target particle size of the tungsten-containing powder.

Step 3: Reduction Step (Reduction of $WO_3$)

When $WO_3$ is sieved in step 2, optimal reduction conditions (such as a temperature, a flow rate of hydrogen, an amount of introduction of the source material, and a facility used) are appropriately selected in accordance with the target particle size of the tungsten-containing powder. By decreasing the temperature to be low or decreasing a partial pressure of water vapor, aggregation tends to be decreased.

When $WO_3$ is reduced to $WO_{2.9}$, the temperature of the reduction atmosphere is, for example, 450° C. or more and 700° C. or less. The $WO_3$ having been sieved can be introduced into a predetermined metal boat to attain a layer thickness of 50 mm or less. Reduction is facilitated by setting the amount of introduction for one layer as small as possible. Further, particles are avoided from being uneven due to aggregation during the reduction, with the result that a W oxide with less aggregation can be likely to be obtained. In the case of the $WO_3$, the source material having been sieved is introduced into a boat. The boat is inserted into a pusher furnace. Reduction is performed until the composition becomes $WO_{2.9}$ and the boat is then removed from the pusher furnace.

Step 4: Intermediate Sieving 1

The powder having the composition of $WO_{2.9}$ is sieved again. The mesh size of the sieve mesh is appropriately changed in accordance with the source material and the target particle size of the tungsten-containing powder particle.

Step 5: Reduction Step

The powder having the composition of $WO_{2.9}$ and having been through the intermediate sieving is introduced into a boat. The boat is inserted into a pusher furnace. Reduction is performed until the composition becomes $WO_2$ and the boat is then removed from the pusher furnace. The temperature of the reduction atmosphere is, for example, 600° C. or more and 800° C. or lower.

The powder can be introduced into a predetermined metal boat to attain a layer thickness of 50 mm or less. Reduction is facilitated by setting the amount of introduction for one layer as small as possible to avoid the particles from being uneven due to aggregation during the reduction, with the result that a W oxide with less aggregation is likely to be obtained. In the case of the $WO_{2.9}$ powder, the source material having been sieved is introduced into the boat. The boat is inserted into a pusher furnace. Reduction is performed until the composition becomes $WO_2$ and the boat is then removed from the pusher furnace.

Step 6: Intermediate Sieving 2

The powder having the composition of $WO_2$ is sieved again. Coarse aggregated particles caused in the reduction step are removed, and the powder under the sieve is collected.

Step 7: Reduction Step (Reduction of $WO_2$ to W)

The $WO_2$ powder having been sieved is introduced into a boat. The boat is inserted into a pusher furnace. Reduction is performed until the composition becomes W and the boat is then removed from the pusher furnace. The temperature of the reduction atmosphere is, for example, 750° C. or more and 1000° C. or less. The powder can be introduced into the predetermined metal boat to attain a layer thickness of 50 mm or less. Reduction is facilitated by setting the amount of introduction for one layer as small as possible to avoid the particles from being uneven due to aggregation during the reduction, with the result that a tungsten-containing powder having uniform particle sizes with less aggregation is likely to be obtained.

In this example, steps 1 to 7 were employed because the $WO_3$ powder was used as the source material; however, when $WO_{2.9}$ was used as the source material, steps 1 to 3 can be omitted. In this case, the production method is started from step 4 of sieving $WO_{2.9}$ serving as the source material.

When the source material is $WO_2$, steps 1 to 5 can be omitted. In this case, the production method is started from step 6 of sieving $WO_2$ serving as the source material.

DETAILS OF EMBODIMENTS OF THE PRESENT DISCLOSURE

EXAMPLES

Samples having one-digit or two-digit sample numbers are examples of the present disclosure, and samples having three-digit sample numbers are comparative examples.

For each of samples No. 1 to No. 3, a $WO_{2.9}$ powder was used as the source material. Coarse part of the powder was removed by sieving with a sieve having a mesh size of 90 to 100 μm. Fine part of the powder was removed by sieving with a sieve having a mesh size of 40 to 50 μm (step 4).

The powder was introduced into a predetermined metal boat. On this occasion, the layer thickness of the powder was set to 50 mm or less. A reduction treatment was performed using a pusher type reduction furnace under a hydrogen atmosphere at 640 to 650° C., thereby obtaining a $WO_2$ powder (step 5).

The obtained $WO_2$ powder was sieved with a sieve having a mesh size of 20 to 30 μm to remove a coarse powder and an aggregated powder. For example, classification can be performed using a classifier (TURBO-SCREENER provided by Freund Turbo) (step 6). The device is not limited to this as long as classification of 30 μm or less can be performed.

The powder under the sieve was further subjected to a reduction treatment using a pusher type reduction furnace under a hydrogen atmosphere at 800 to 820° C. with a layer thickness of 10 mm or less, thereby obtaining a tungsten-containing powder (step 7).

For production of each of samples No. 4 to No. 23, a $WO_3$ powder was used as the source material.

The $WO_3$ powder was sieved with a sieve having a mesh size of 90 or 100 μm, thereby removing a coarse powder and an aggregated powder. A fine powder was removed using a sieve having a mesh size of 40 to 50 μm (step 2).

The powder on the sieve was used and was introduced into a predetermined container. On this occasion, the layer thickness of the powder was set to 50 mm or less. A reduction treatment was performed using a pusher type reduction furnace under a hydrogen atmosphere at a reduction temperature of 600° C., thereby obtaining a $WO_{2.9}$ powder (step 3).

The $WO_{2.9}$ powder obtained by the reduction was sieved with a sieve having a mesh size of 75 or 90 μm, and the powder under the sieve was collected. Further, sieving was performed with a sieve having a mesh size of 45 μm, thereby obtaining the powder on the sieve (step 4).

The powder under the sieve was layered in the form of a layer. A reduction treatment was performed using a pusher type reduction furnace under a hydrogen atmosphere at a reduction temperature of 640° C. to 760° C. with a layer thickness of 50 mm or less. In this way, a $WO_2$ powder was obtained (step 5).

The $WO_2$ powder obtained by the reduction was sieved with a sieve having a mesh size of 20 to 70 μm to remove a coarse powder and an aggregated powder (step 6). The classification method is not limited to this as long as classification of 70 μm or less can be performed.

The obtained $WO_2$ under the sieve was layered in the form of a layer and was subjected to a reduction treatment using a pusher type reduction furnace under a hydrogen atmosphere at a reduction temperature of 800° C. to 1000° C. with a layer thickness of 30 mm or less, thereby obtaining a tungsten-containing powder (step 7).

The particle sizes of the obtained tungsten-containing powders of samples No. 1 to No. 23 were measured by the FSSS method, and the FSSS average particle sizes were 0.5 to 30 μm. Production conditions for these powders are shown in Table 1.

TABLE 1

| Sample No. | Source Material Preparation | Mesh Size of Sieve for Source Material ($WO_3$) (Step 2) μm | Reduction Temperature (Step 3) ° C. | Mesh Size of Sieve for Source Material ($WO_{2.9}$) (Step 4) μm | Reduction Temperature (Step 5) ° C. | Mesh Size of Sieve for Source Material ($WO_2$) (Step 6) μm | Reduction Temperature (Step 7) ° C. | Particle Size a (FSSS) of Tungsten-Containing Powder μm |
|---|---|---|---|---|---|---|---|---|
| 1 | $WO_{2.9}$ | — | — | 50/90 | 640 | 20 | 800 | 0.50 |
| 2 | $WO_{2.9}$ | — | — | 40/100 | 640 | 30 | 800 | 0.51 |
| 3 | $WO_{2.9}$ | — | — | 50/90 | 650 | 20 | 820 | 0.63 |
| 4 | $WO_3$ | 40/100 | 600 | 45/90 | 670 | 30 | 830 | 1.34 |
| 5 | $WO_3$ | 50/90 | 600 | 45/75 | 670 | 20 | 840 | 1.50 |
| 6 | $WO_3$ | 40/100 | 600 | 45/90 | 680 | 30 | 900 | 2.03 |
| 7 | $WO_3$ | 50/90 | 600 | 45/75 | 700 | 20 | 900 | 2.51 |
| 8 | $WO_3$ | 50/90 | 600 | 45/75 | 720 | 20 | 930 | 3.78 |
| 9 | $WO_3$ | 50/90 | 600 | 45/75 | 730 | 20 | 960 | 4.60 |
| 10 | $WO_3$ | 50/90 | 600 | 45/75 | 740 | 20 | 960 | 4.98 |
| 11 | $WO_3$ | 40/100 | 600 | 45/90 | 740 | 30 | 960 | 5.0 |
| 12 | $WO_3$ | 50/90 | 600 | 45/75 | 740 | 20 | 960 | 5.0 |
| 13 | $WO_3$ | 50/90 | 600 | 45/75 | 740 | 20 | 960 | 5.1 |
| 14 | $WO_3$ | 50/90 | 600 | 45/75 | 750 | 50 | 970 | 9.8 |
| 15 | $WO_3$ | 40/100 | 600 | 45/90 | 750 | 60 | 970 | 10.0 |
| 16 | $WO_3$ | 50/90 | 600 | 45/75 | 760 | 50 | 980 | 14.2 |
| 17 | $WO_3$ | 50/90 | 600 | 45/75 | 760 | 50 | 980 | 15.3 |
| 18 | $WO_3$ | 50/90 | 600 | 45/75 | 760 | 60 | 1000 | 21 |
| 19 | $WO_3$ | 50/90 | 600 | 45/75 | 760 | 60 | 1000 | 25 |
| 20 | $WO_3$ | 40/100 | 600 | 45/90 | 760 | 70 | 1000 | 26 |
| 21 | $WO_3$ | 50/90 | 600 | 45/75 | 760 | 60 | 1000 | 29 |
| 22 | $WO_3$ | 40/100 | 600 | 45/90 | 760 | 70 | 1000 | 30 |
| 23 | $WO_3$ | 50/90 | 600 | 45/75 | 760 | 60 | 1000 | 30 |

For each of samples No. 101 and No. 102 each serving as a comparative example, $WO_{2.9}$ was used as the source material. The source material was introduced into a predetermined container to attain a layer thickness of 10 mm or less. A reduction treatment was performed using a pusher type reduction furnace under a hydrogen atmosphere at a reduction temperature of 800° C. to 820° C., thereby obtaining a tungsten-containing powder.

For each of samples No. 103 to No. 110 each serving as a comparative example, $WO_3$ was used as the source material. The source material was introduced into a predetermined container to attain a layer thickness of 30 mm or less. A reduction treatment was performed using a pusher type reduction furnace under a hydrogen atmosphere at a reduction temperature of 840° C. to 1000° C., thereby obtaining a tungsten-containing powder. Production conditions for these powders are shown in Table 2.

TABLE 2

| Sample No. | Source Material Preparation | Mesh Size of Sieve for Source Material ($WO_3$) μm | Reduction Temperature ° C. | Mesh Size of Sieve for Source Material ($WO_{2.9}$) μm | Reduction Temperature ° C. | Mesh Size of Sieve for Source Material ($WO_2$) μm | Reduction Temperature ° C. | Particle Size a (FSSS) of Tungsten-Containing Powder μm |
|---|---|---|---|---|---|---|---|---|
| 101 | $WO_{2.9}$ | — | — | — | — | — | 800 | 0.50 |
| 102 | $WO_{2.9}$ | — | — | — | — | — | 820 | 0.90 |
| 103 | $WO_3$ | — | — | — | — | — | 840 | 1.57 |
| 104 | $WO_3$ | — | — | — | — | — | 900 | 1.89 |
| 105 | $WO_3$ | — | — | — | — | — | 960 | 3.20 |
| 106 | $WO_3$ | — | — | — | — | — | 960 | 4.00 |
| 107 | $WO_3$ | — | — | — | — | — | 960 | 5.1 |
| 108 | $WO_3$ | — | — | — | — | — | 960 | 8.5 |
| 109 | $WO_3$ | — | — | — | — | — | 980 | 15.3 |
| 110 | $WO_3$ | — | — | — | — | — | 1000 | 24 |

The FSSS average particle size of the tungsten-containing powder, TD (p), and density variation of a sintered material obtained by sintering the tungsten-containing powder were investigated. The powder containing 30 g of tungsten was introduced into a mold having a length of 10 mm and a width of 30 mm and press molding was performed using a 30 t press machine to apply a pressure of 98 MPa. The press-molded compact was sintered at 1300 to 1900° C. for 3 hours, and the density of the sintered material was measured using the Archimedes method. Results are shown in Tables 3 and 4.

TABLE 3

| Sample No. | Particle Size a (FSSS) of Tungsten-Containing Powder [μm] | TD (p) [g/cm³] | 0.37a + 7.04 or 0.09a + 8.44 | 0.32a + 7.76 or 0.1a + 8.86 | Density Variation of Sintered Material [g/cm³] |
|---|---|---|---|---|---|
| 1 | 0.50 | 7.94 | 7.23 | 7.92 | 0.11 |
| 2 | 0.51 | 7.25 | 7.23 | 7.92 | 0.19 |
| 3 | 0.63 | 9.80 | 7.27 | 7.96 | 0.09 |
| 4 | 1.34 | 7.69 | 7.54 | 8.19 | 0.20 |
| 5 | 1.50 | 9.26 | 7.60 | 8.24 | 0.06 |
| 6 | 2.03 | 8.06 | 7.79 | 8.41 | 0.18 |
| 7 | 2.51 | 9.01 | 7.97 | 8.56 | 0.05 |
| 8 | 3.78 | 10.00 | 8.44 | 8.97 | 0.12 |
| 9 | 4.60 | 10.20 | 8.74 | 9.23 | 0.15 |
| 10 | 4.98 | 10.99 | 8.88 | 9.35 | 0.14 |
| 11 | 5.0 | 8.93 | 8.89 | 9.36 | 0.20 |
| 12 | 5.0 | 10.00 | 8.89 | 9.36 | 0.14 |
| 13 | 5.1 | 9.43 | 8.90 | 9.37 | 0.07 |
| 14 | 9.8 | 10.00 | 9.32 | 9.84 | 0.14 |
| 15 | 10.0 | 9.43 | 9.34 | 9.86 | 0.19 |
| 16 | 14.2 | 10.64 | 9.72 | 10.28 | 0.15 |
| 17 | 15.3 | 11.49 | 9.82 | 10.39 | 0.12 |
| 18 | 21 | 11.63 | 10.33 | 10.96 | 0.15 |
| 19 | 25 | 11.36 | 10.69 | 11.38 | 0.14 |
| 20 | 26 | 10.87 | 10.78 | 11.46 | 0.17 |
| 21 | 29 | 12.05 | 11.05 | 11.76 | 0.12 |
| 22 | 30 | 11.24 | 11.14 | 11.86 | 0.20 |
| 23 | 30 | 11.90 | 11.14 | 11.86 | 0.16 |

TABLE 4

| Sample No. | Particle Size a (FSSS) of Tungsten-Containing Powder [μm] | TD(p) [g/cm³] | 0.37a + 7.04 or 0.09a + 8.44 | 0.32a + 7.76 or 0.1a + 8.86 | Density Variation of Sintered Material [g/cm³] |
|---|---|---|---|---|---|
| 101 | 0.50 | 3.63 | 7.23 | 7.92 | 0.35 |
| 102 | 0.90 | 5.05 | 7.37 | 8.05 | 0.32 |
| 103 | 1.57 | 6.10 | 7.62 | 8.26 | 0.23 |
| 104 | 1.89 | 6.25 | 7.74 | 8.36 | 0.37 |
| 105 | 3.20 | 7.35 | 8.22 | 8.78 | 0.23 |
| 106 | 4.00 | 7.94 | 8.52 | 9.04 | 0.24 |
| 107 | 5.1 | 7.98 | 8.90 | 9.37 | 0.22 |
| 108 | 8.5 | 8.06 | 9.21 | 9.71 | 0.26 |
| 109 | 15.3 | 9.26 | 9.82 | 10.39 | 0.34 |
| 110 | 24 | 9.26 | 10.60 | 11.26 | 0.35 |

In the column "0.37a+7.04 or 0.09a+8.44" in each of Tables 3 and 4, a value of "0.37a+7.04" is shown when FSSS average particle size a is 5.0 μm or less, and a value of "0.09a+8.44" is shown when a is 5.0 μm or more.

In the column "0.32a+7.76 or 0.1a+8.86" in each of Tables 3 and 4, a value of "0.32a+7.76" is shown when FSSS average particle size a is 5.0 μm or less, and a value of "0.1a+8.86" is shown when a is 5.0 μm or more.

From the results of Tables 3 and 4, it was confirmed that the density variation of the sintered material becomes small in the case where a relational expression of $p \geq 0.37a+7.04$ is satisfied when the range of FSSS average particle size a is $0.5\ \mu m \leq a \leq 5.0\ \mu m$ or in the case where a relational expression of $p \geq 0.09a+8.44$ is satisfied when the range of FSSS average particle size a is $5.0\ \mu m \leq a \leq 30\ \mu m$.

The embodiments and examples disclosed herein are illustrative and non-restrictive in any respect. The scope of the present invention is defined by the terms of the claims, rather than the embodiments described above, and is intended to include any modifications within the scope and meaning equivalent to the terms of the claims.

The invention claimed is:

1. A tungsten-containing powder including tungsten, wherein a ratio of the tungsten in the tungsten containing powder is 90 mass % or more, wherein an FSSS average particle size of the tungsten-containing powder as obtained by an FSSS method is defined as "a" (μm) and a density TD, which is an inverse number of a tap volume of the tungsten-containing powder, is defined as p (g/cm³), and a relational expression of $p \geq 0.37a+7.04$ is satisfied wherein a range of the FSSS average particle size a is 0.5 μm≤a≤2.51 μm or 3.78 μm≤a≤5.0 μm, wherein a density variation of a sintered material is 0.05 $g/cm^3$ or more and 0.20 $g/cm^3$ or less measured by subjecting the tungsten containing powder to press molding at a pressure of 98 MPa and sintering at 1300-1900° C. for 3 hours and measuring density by Archimedes method.

2. The tungsten-containing powder according to claim 1, wherein the range of the FSSS average particle size a is 0.5 μm≤a≤2.03 μm or 4.60 μm≤a≤5.0 μm.

3. A tungsten-containing powder including tungsten, wherein a ratio of the tungsten in the tungsten containing powder is 90 mass % or more, wherein an FSSS average particle size of the tungsten-containing powder as obtained by an FSSS method is defined as "a" (μm) and a density TD, which is an inverse number of a tap volume of the tungsten-containing powder, is defined as p ($g/cm^3$), and a relational expression of p≥0.09a+8.44 is satisfied wherein a range of the FSSS average particle size a is 5.0 μm<a≤15.3 μm or 21 μm≤a≤30 μm, wherein a density variation of a sintered material is 0.07 $g/cm^3$ or more and 0.20 $g/cm^2$ or less measured by subjecting the tungsten containing powder to press molding at a pressure of 98 MPa and sintering at 1300-1900° C. for 3 hours and measuring density by Archimedes method.

4. The tungsten-containing powder according to claim 3, wherein the range of the FSSS average particle size a is 5.0 μm<a≤14.2 μm or 25 μm≤a≤30 μm.

5. A tungsten-containing powder including tungsten, wherein a ratio of the tungsten in the tungsten-containing powder is 90 mass % or more, wherein a density variation of a sintered material is 0.05 $g/cm^3$ or more and 0.20 $g/cm^3$ or less measured by subjecting the tungsten containing powder to press molding at a pressure of 98 MPa and sintering at 1300-1900° C. for 3 hours and measuring density by Archimedes method.

6. The tungsten-containing powder according to claim 5, wherein a density TD, which is an inverse number of a tap volume of the tungsten-containing powder, is defined as p ($g/cm^3$), an upper limit of p is 12.1 $g/cm^3$.

7. The tungsten-containing powder according to claim 5, wherein an FSSS average particle size of the tungsten-containing powder as obtained by an FSSS method is defined as "a" (μm) wherein a range of the FSSS average particle size a is 0.5 μm≤a≤2.51 μm or 3.78 μm≤a≤5.0 μm.

8. The tungsten-containing powder according to claim 5, wherein the density variation of a sintered material is 0.07 $g/cm^3$ or more and 0.20 $g/cm^3$ or less measured by subjecting the tungsten containing powder to press molding at a pressure of 98 MPa and sintering at 1300-1900° C. for 3 hours and measuring density by Archimedes method.

9. The tungsten-containing powder according to claim 8, wherein an FSSS average particle size of the tungsten-containing powder as obtained by an FSSS method is defined as "a" (μm) wherein a range of the FSSS average particle size a is 5.0 μm<a≤15.3 μm or 21 μm≤a≤30 μm.

10. The tungsten-containing powder according to claim 5, wherein the density variation of a sintered material is 0.05 $g/cm^3$ or more and 0.15 $g/cm^3$ or less measured by subjecting the tungsten containing powder to press molding at a pressure of 98 MPa and sintering at 1300-1900° C. for 3 hours and measuring density by Archimedes method.

* * * * *